United States Patent [19]

McGill

[11] Patent Number: 4,961,369

[45] Date of Patent: Oct. 9, 1990

[54] GUN LAYING

[75] Inventor: Keith R. McGill, Erith, England

[73] Assignee: The Secretary of State for Defence in Her Britannic Majesty's Government of the United Kingdom of Great Britain and Northern Ireland, London, England

[21] Appl. No.: 573,699

[22] Filed: Jan. 13, 1984

[30] Foreign Application Priority Data

Jan. 21, 1983 [GB] United Kingdom ..... 8301653

[51] Int. Cl.[5] ..... F41G 3/10

[52] U.S. Cl. ..... 89/41.11; 33/240

[58] Field of Search ..... 33/240; 89/41.11, 41.19; 235/407

[56] References Cited

U.S. PATENT DOCUMENTS

| | | | |
|---|---|---|---|
| 792,180 | 6/1905 | Ternstrom | 89/41.19 |
| 794,649 | 7/1905 | Ternstrom | 89/41.11 |
| 1,684,825 | 9/1928 | Henderson | 89/41.19 |

*Primary Examiner*—Stephen C. Bentley

*Attorney, Agent, or Firm*—Nixon & Vanderhye

[57] ABSTRACT

A gun laying aid for determining the offset in the bearing of a gun due to trunnion tilt. The gun laying aid has a support member on which are rotatably mounted a bearing indicator member and a reference member. A correction indicator is pivotally mounted on the reference member and held in contact with an indicator portion of the bearing indicator member. When correctly orientated, as indicated by the level indicating means, the amount of rotation of the correction indicator relative to the reference member is indicative of the offset of the gun bearing due to trunnion tilt, which rotation is measured by the measuring means.

11 Claims, 6 Drawing Sheets

GUN LAYING

The invention relates to gun laying, particularly to devices for correcting a gun's bearing to compensate for trunnion tilt.

When a gun is fired in what is commonly referred to as the indirect fire mode, that is when the target is not visible from the gun so that direct sighting is impossible, it is normally directed from a command post which can acquire intelligence of the target's position by some means such as forward observers. When the command post knows the relative positions of the target and the gun the elevation and bearing necessary for the gun to hit the target can be calculated and transmitted to the gun. The bearing will depend upon the direction of the target from the gun and such other factors as drift, wind effects and rotation of the earth. The elevation will depend upon such factors as the relative altitudes of the gun and target, the distance of the target from the gun and the type of charge used.

To ensure that the elevation and bearing indicated by the gun's sight correspond to the elevation and bearing of the gun it is known to use a levelling device integral with the sighting system with mechanical linkages to the gun whereby the sight is automatically offset to compensate for elevation and bearing errors introduced by trunnion tilt. When this technique is used in a self-propelled gun, hereinafter referred to as an SP, it is necessary to have a large aperture in the armour of the vehicle turret to allow the sight to be moved into a vertical position. This is most undesirable, however, as it seriously reduces the protection for the gun crew.

The need for a large aperture is overcome by the use of a fixed sight with a sighting head outside the turret rotatable through 360° in azimuth. A gunner within the SP can view outside the turret through the sight and is able to control and monitor the direction in which the sight points by means of controls and instruments associated with the sight. The required elevation and bearing are again transmitted from the command post to the SP but the corrections to the elevation and bearing necessary to compensate for any trunnion tilt are determined by an electronic plane converter mounted in the SP.

In order to set up a gun battery a process known as surveying-in is performed to orientate the gun of each SP on the centre of arc, that is, on the approximate centre of an art in which the proposed targets are located. When each SP has reached the position from where it is going to fire the director sets up a theodolite on some piece of ground from where he can see, and be seen by, each SP. The gunner of each SP rotates the sight until it is aligned with the director. The bearing of the gun from the director and the centre of arc bearing are transmitted to the SP and fed into the electronic plane converter. The electronic plane converter is then used to align the gun to the centre of arc bearing.

When an SP has its gun pointing at the centre of arc the gunner moves his sight until it points at an easily identifiable feature which will be that SP's gun aiming point. The gun aiming point should be further than 2,000 meters from the SP. Alternatively, a parallelo-scope can be used to define a reference direction. The sight slipping scales are then set to read the bearing of the centre of arc.

When the gun is to be aimed at a target the gunner aligns the sight on the gun aiming point and the directed bearing and elevation are fed into the electronic plane converter which is then used to lay the gun.

Throughout the surveying-in and laying procedures the electronic plane converter corrects the elevation and bearing of the gun to compensate for any trunnion tilt.

In the event of the failure of the electronic plane converter the elevation of the gun could be set by the use of an elevation drum but there is a requirement for a non-electronic device capable of determining the offset in bearing of a gun due to trunnion tilt. It is the object of the present invention to provide such a non-electronic device.

According to the present invention there is provided a gun laying aid characterised in that there is included

- a support member;
- a bearing indicating member pivotally mounted on the support member so as to be pivotable about a first axis and having an indicator portion extended in a plane parallel to the first axis;
- a reference member rotatably mounted on the support member so as to be rotatable about a second axis which intersects the first axis perpendicularly at a common intersection point;
- a correction indicator pivotally mounted on the reference member so as to be pivotable about a third axis which intersects the second axis at the said common intersection point and is contactable with the indicator portion of the bearing indicating member;
- a measuring means cooperative with the reference member and the correction indicator conjointly so as to measure their relative angular displacement about the third axis; and
- level indicating means arranged to indicate when the indicator portion of the bearing indicating member and the third axis lie in vertical planes.

When the first axis is parallel to the axis of the gun barrel, i.e. the "gun-line", and the second axis is parallel to the trunnion axis—as may be conveniently achieved by fixing the support member of the gun-laying aid onto the trunnion in the correct orientation—any vertical plane parallel to the first axis will be parallel to the gun-line and therefore parallel to the gun's actual bearing. In particular, the indicator portion of the bearing indicating member will lie in such a plane when made vertical.

When the gun-laying aid is set in this position the horizontal which passes through the common intersection point and which also lies in the vertical plane containing the first axis is parallel to the gun's actual bearing. The horizontal which passes through the common intersection point and is perpendicular to the second axis is parallel to the bearing the gun would have if it were lowered or raised to the horizontal. The angle of intersection of these two horizontals is therefore equal to the change in gun bearing due to elevating the gun from the horizontal when trunnion tilt is present.

If the reference member is rotated about the second axis until the third axis lies in a vertical plane it will be aligned to the horizontal gun-line for all angles of trunnion tilt and so provides a reference against which the bearing offset can be measured.

If the correction indicator is pivoted relative to the reference member to maintain contact with indicator portion of bearing indicating member, it will pivot relative to the reference member to an angle equal to the angle of offset. This relative angular displacement of the correction indicator and reference member is measured by the measuring means which therefore indicates the bearing offset.

The correction indicator may be a pointer, an extremity of which co-operates with a bearing correction scale fixed to the reference member to indicate the relative angular displacements of the pointer and reference member. Alternatively the correction indicator may comprise a lever pivotable on the reference member which moves a circular bearing correction scale coaxial with the third axis. A pointer fixed to the reference member adjacent the scale will then permit measurement of the rotation of the correction indicator relative to the reference member.

The reference member may be mounted on the support member by means of an intermediate member so as to permit the reference member to also pivot about a fourth axis which intersects the second axis perpendicularly at the common intersection point. Because the third axis can now be set parallel to the indicator portion of the bearing indicating member, the angular position of the correction indicator relative to the reference member is not dependant on the point of contact of the correction indicator and the bearing correction member, it is also not dependent on the displacement of plane of the indicator portion from the first axis.

If, however, the reference member is mounted on the support member so that it is able to rotate about the second axis only, the correction indicator must contact the indicator portion of the bearing indicating member at a position that is co-linear with the horizontal through the common intersection point when the gun-laying aid is in the operating position. This is achieved by, for example, providing the correction indicator with a horizontal knife edge the extension of which intersects the third axis perpendicularly at the common intersection point.

Preferably, the gun laying aid further includes an elevation drum rotatably mounted on the bearing indicating member with an axis of rotation perpendicular to, but not necessarily intersecting, the first axis and having a scale arranged to indicate the angle of elevation of the first axis from the horizontal. The inclusion of an elevation drum allows the directed elevation to be set with the same gun laying aid that is used to correct the gun's bearing for trunnion tilt rather than depending upon a separate device such as an elevation drum mounted elsewhere on the gun barrel.

Two embodiments of the invention will now be described by way of example only with reference to the accompanying drawings of which FIG. 1 is a perspective representation of a first embodiment comprising a laying aid in which the reference member is mounted on the support member by means of an intermediate member;

FIGS. 1–4 and 6 show gun laying aids mounted coaxially on a gun trunnion 1 by means to be described later with particular reference to FIG. 5.

Figure 1:
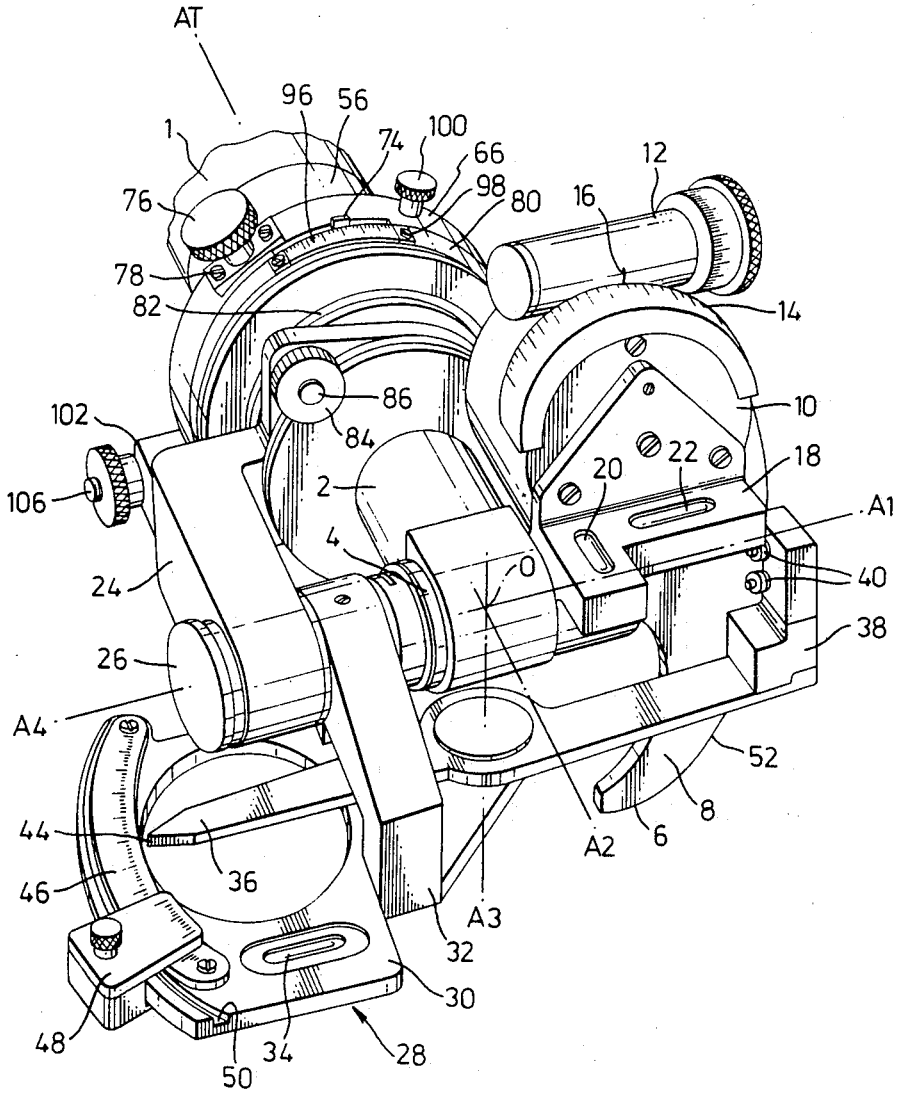

The gun laying aid illustrated in FIG. 1 has a support member 2 in which is pivotally mounted an axis pin 4 pivotable about an axis A1 constituting the first axis. A plate 6 constituting the bearing indicating member is fixed to the axis pin 4 so that a planar surface 8 of the plate 6 is co-planar with the first axis A1, which surface constitutes the indicator portion.

An elevation drum 10 is rotatably mounted on the plate 6 with its axis of rotation perpendicular to the planar surface 8. The elevation drum 10 is rotatable relative to the plate 6 by a fine adjustment control 12 fixed to the plate 6. An elevation scale 14 is fixed to the elevation drum adjacent a datum line 16 marked on the fine adjustment control 12 so that the angle of rotation of the elevation drum 10 relative to the plate 6 from its zero position can be measured. The elevation scale 14 is marked in mils.

Figure 2:
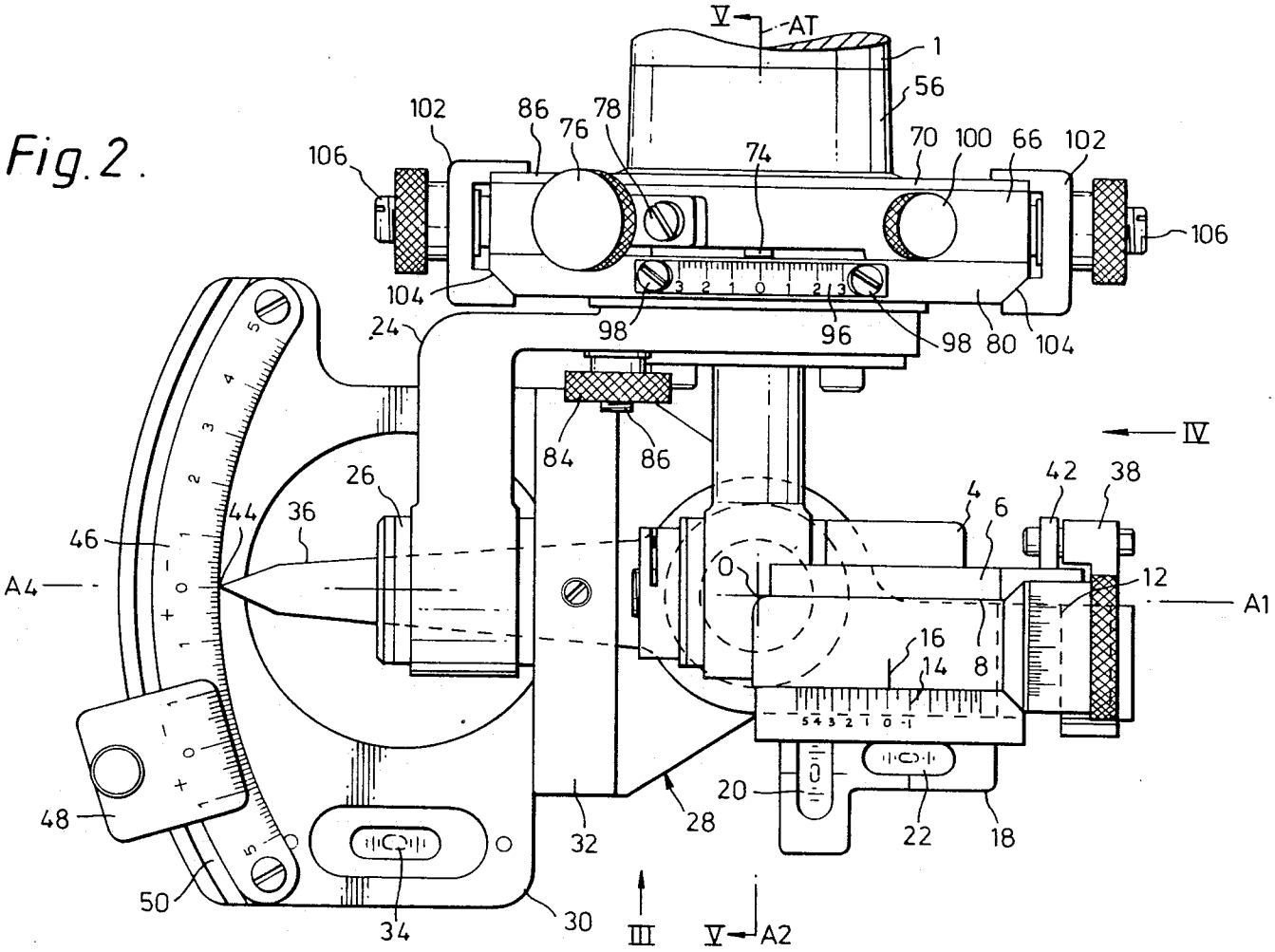
FIG. 2 is a detailed plan view of the gun laying aid shown in FIG. 1.

With particular reference to FIG. 2, there is shown fixed to the elevation drum 10 a T-bubble plane indicator 18 having a transverse levelling bubble 20 which indicates when the plate 6 is vertical and longitudinal levelling bubble 22 which, if the elevation scale 14 is zeroed to the datum line 16, indicates when the first axis A1 is horizontal.

A right-angular bracket 24 is rotatably mounted on the support member 2 so that its axis of rotation A2, constituting the second axis, intersects the first A1 perpendicularly at the common intersection point 0. The support member 2 is mounted on the gun trunnion 1 so that the second axis A2 is co-linear with the trunnion axis AT.

A carrier pivot 26 pivotally mounted in the right-angular bracket 24 has a pivot axis A4 which intersects the second axis A2 perpendicularly at the common intersection point 0. A scale carrier 28, constituting the reference member, comprises a plate 30 dependent from a suspension yoke 32 fixed to the carrier pivot 26. A pointer 36, constituting the correction indicator, is pivotally mounted on the plate 30 of the scale carrier 28 with a pivot axis A3, which constitutes the third axis (see FIG. 3), which intersects the second axis A2 at the common intersection point. A longitudinal levelling bubble 34 mounted on the plate 30 is arranged to indicate when the third axis A3 lies in a vertical plane.

The transverse levelling bubble 20 and the longitudinal levelling bubble 22 together constitute the level indicating means. The pointer 36 is connected to the plate 6 by a runner 38 fixed to one end of the pointer 36. The runner 38 includes two rollers 40 that can roll on the planar surface 8 and a third roller 42 which is spring loaded to keep the two rollers 40 in contact with the planar surface 8.

The pointer 36 has an extremity 44 which is movable with the plate 6 and arranged to be co-planar with the planar surface 8. The pointer extremity 44 will lie in the vertical plane through the first axis A1 when the plate 6 is vertical as indicated by the transverse levelling bubble 20.

An arcuate bearing correction scale 46 is fixed to the scale carrier 28 so that it lies in a plane perpendicular to the third axis A3 and has its centre of curvature on the axis A3. It is located adjacent the pointer extremity 44. An adjustable scale 48 is mounted in a key-way 50 in the plate 30 so as to be slidable along the bearing correction scale 46.

The plate 5 has a lower curved edge 52 (see FIG. 3) having its centre of curvature at the common intersection point 0. The curved edge 52 allows the runner 38, the scale carrier 28 and the bearing correction scale 46 to rotate about the second axis A2 as the right-angular bracket 24 is rotated about the support member 2.

When the scale carrier 28 and the bearing correction scale 46 are rotated about the fourth axis A4 the pointer 36 will cause the plate 6 to pivot about the first axis A1 and vice-versa. In particular, if the fourth axis A4 is horizontal as indicated by the longitudinal levelling bubble 34 then when the planar surface 8 is vertical the bearing correction scale 46 will be horizontal.

Figure 5:
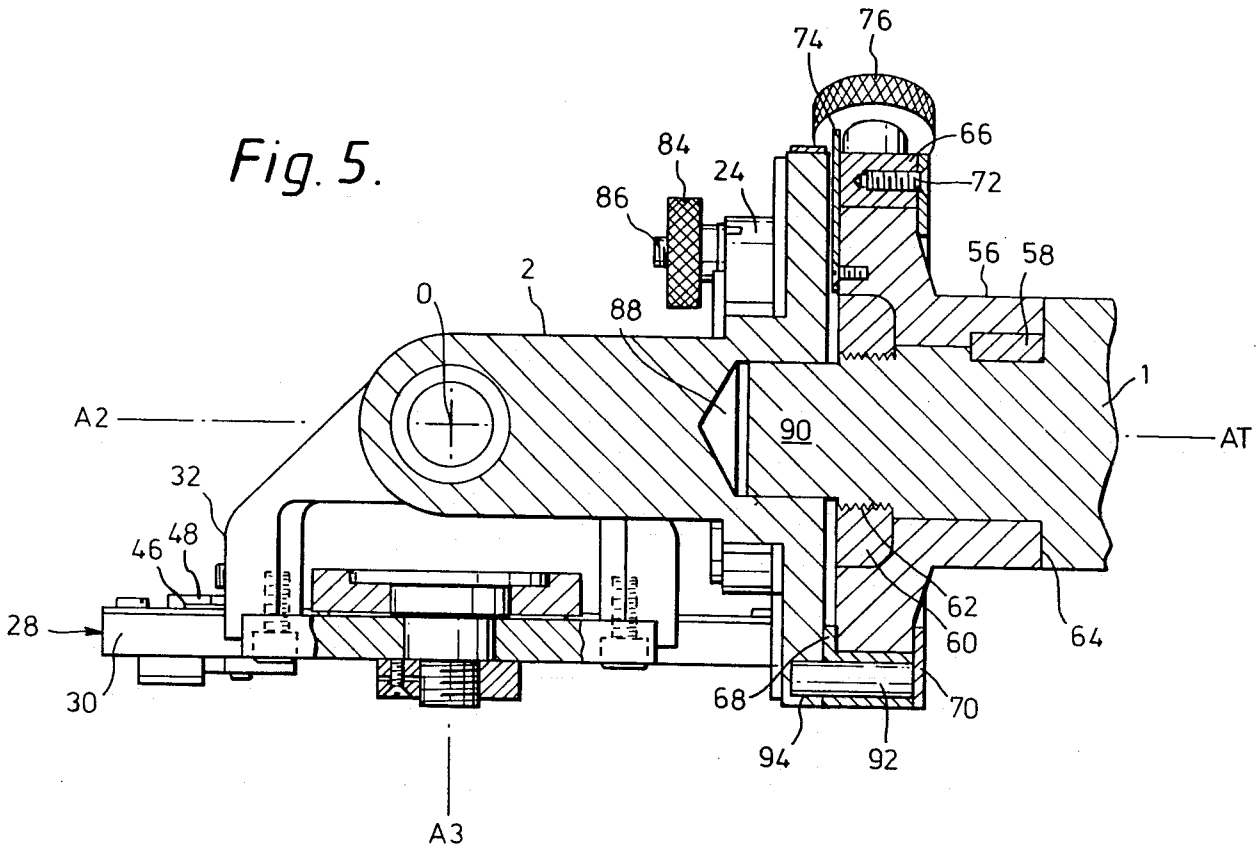
FIG. 5 is a detailed cross-section of the same gun laying aid taken on the line V—V of FIG. 2.

Referring now to FIG. 5 there is shown a means of fixing the support member 2 of the gun laying aid to the gun trunnion 1.

A mounting flange 56 is fixed to the gun trunnion 1. It is located angularly by a key 58 and axially by a securing nut 60 tightened on a threaded portion 62 of the gun trunnion 1 to hold the mounting flange 56 against a shoulder 64 of the gun trunnion 1.

A mounting ring 66 is arranged for limited rotation about the mounting flange 56 and is located to it axially by a rim 68 and a mounting plate 70 fixed to the mounting ring 66 by screws 72. A pointer 74 fixed to the mounting flange 56 extends radially beyond the mounting ring 66. The rim 68 of the mounting ring 66 is partly cut away in the region of the pointer 74 to allow the mounting ring 66 to rotate, to a limited degree, on the mounting flange 56.

Figure 3:
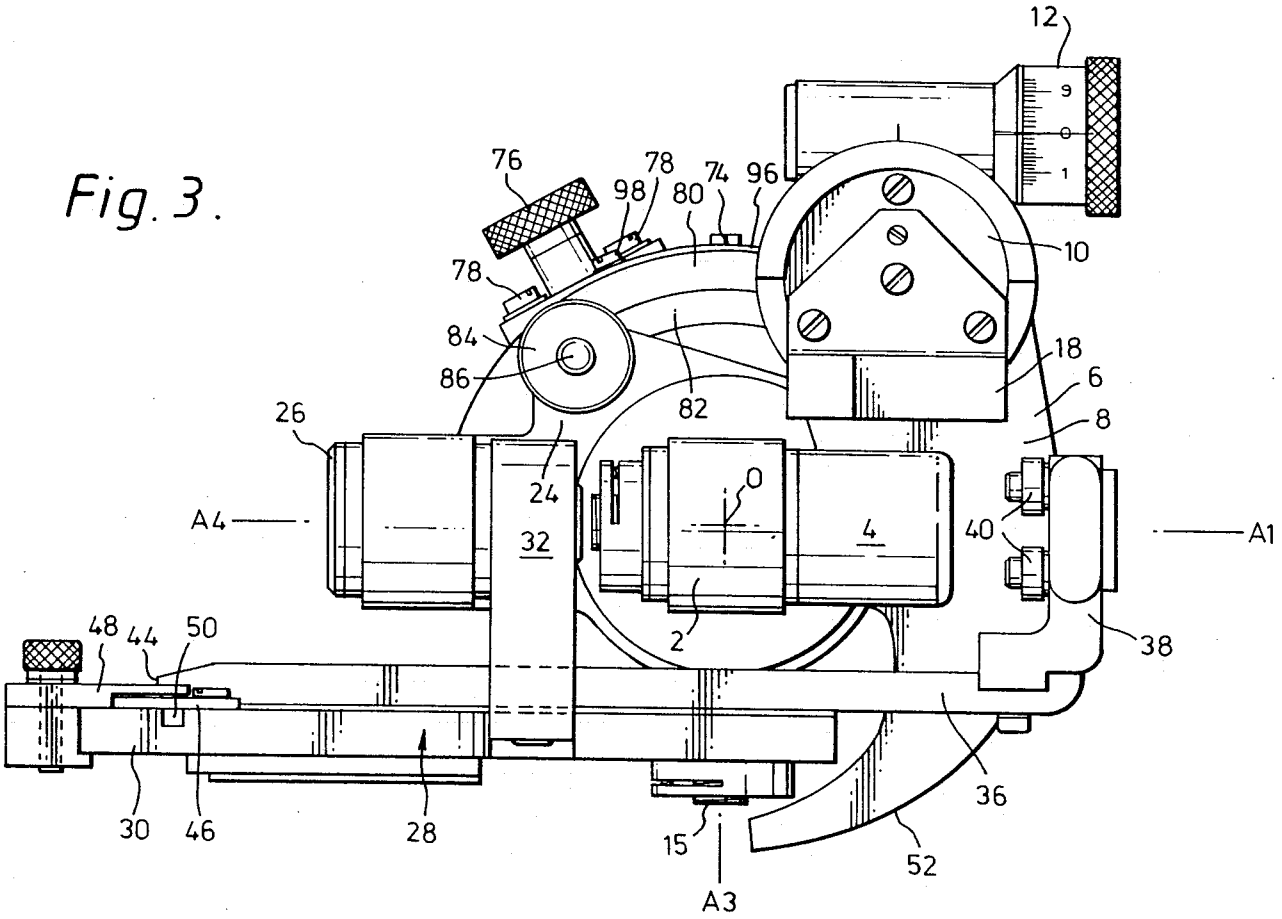
FIG. 3 is a detailed side elevation of the gun laying aid viewed in the direction of the arrow III of FIG. 2.
Figure 4:
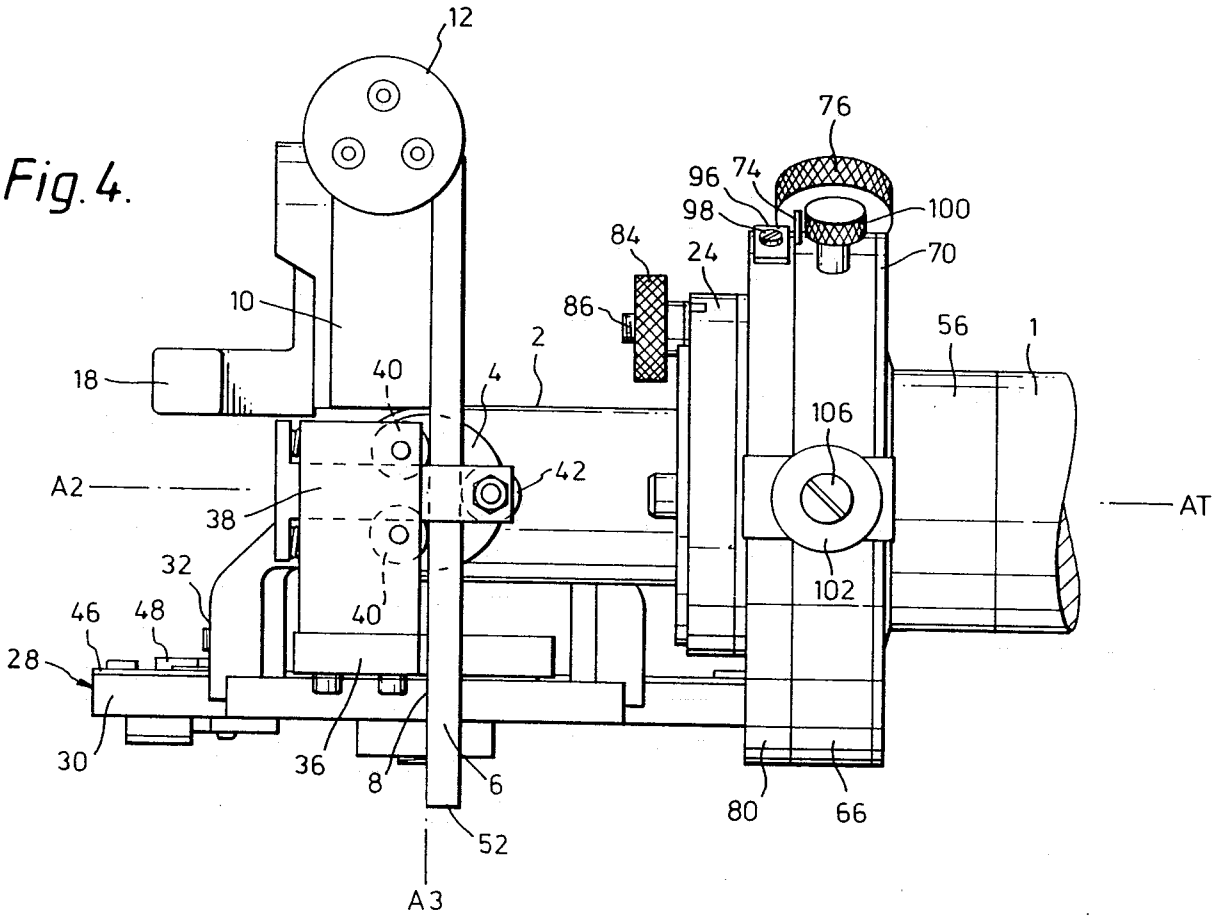
FIG. 4 is a detailed end elevation of the gun laying aid viewed in the direction of the arrow IV of FIG. 2.

A detent plunger 76 is mounted on the mounting ring 66 by two locating screws 78 (see FIG. 3). The detent plunger 76 engages with a recess (not shown) in the mounting flange 56 to fix the mounting ring 66 in angular register with the mounting flange 56 and so also, with the gun trunnion 1. When the detent plunger 76 is engaged it is possible to adjust the angular register of the mounting ring 66 relative to the mounting flange 56 by a small angle by adjusting the angular location of the detent plunger 76 relative to the mounting ring 66 by means of the two locating screws 78.

The support member 2 broadens into a flange 80. The flange 80 has an arcuate slit 82 (see FIG. 3). A clamping nut 84 can be tightened onto a clamping bolt 86 which is mounted in the right-angular bracket 24 and is slidable along the arcuate slit 82 in order to fix the right-angular bracket 24 angularly relative to the support member 2.

A centralising recess 88 in the support member 2 engages with the extremity of the gun trunnion 1 which is in the form of a centralising pin 90 thereby ensuring that the second axis A2 of the gun laying aid and the trunnion axis are co-linear. A locating pin 92 protrudes from the lower part of the mounting ring 66 and engages in a recess 94 in the flange 80 to locate the support member 2 in angular register with the mounting ring 66.

Referring now to FIG. 2 a survey scale 96 is fixed to the flange 80 by two screws 98 which allow the scale 96 to be adjusted circumferentially on the flange 80 for initial zeroing which will be described later.

When the detent plunger 76 is disengaged the mounting ring 66 together with the support member 2 can be rotated about the gun trunnion 1 and the mounting flange 56 through a limited angle and locked in position by a locking screw 100. The angle of rotation is indicated on the survey scale 96 by the pointer 74.

The flange 80 is clamped to the mounting plate 70 by two clamps 102 to retain the support member 2 axially on the mounting flange 56. Each clamp 102 is pressed into an appropriate bevelled portion 104 of the flange 80 by clamping screws 106.

Figure 6:
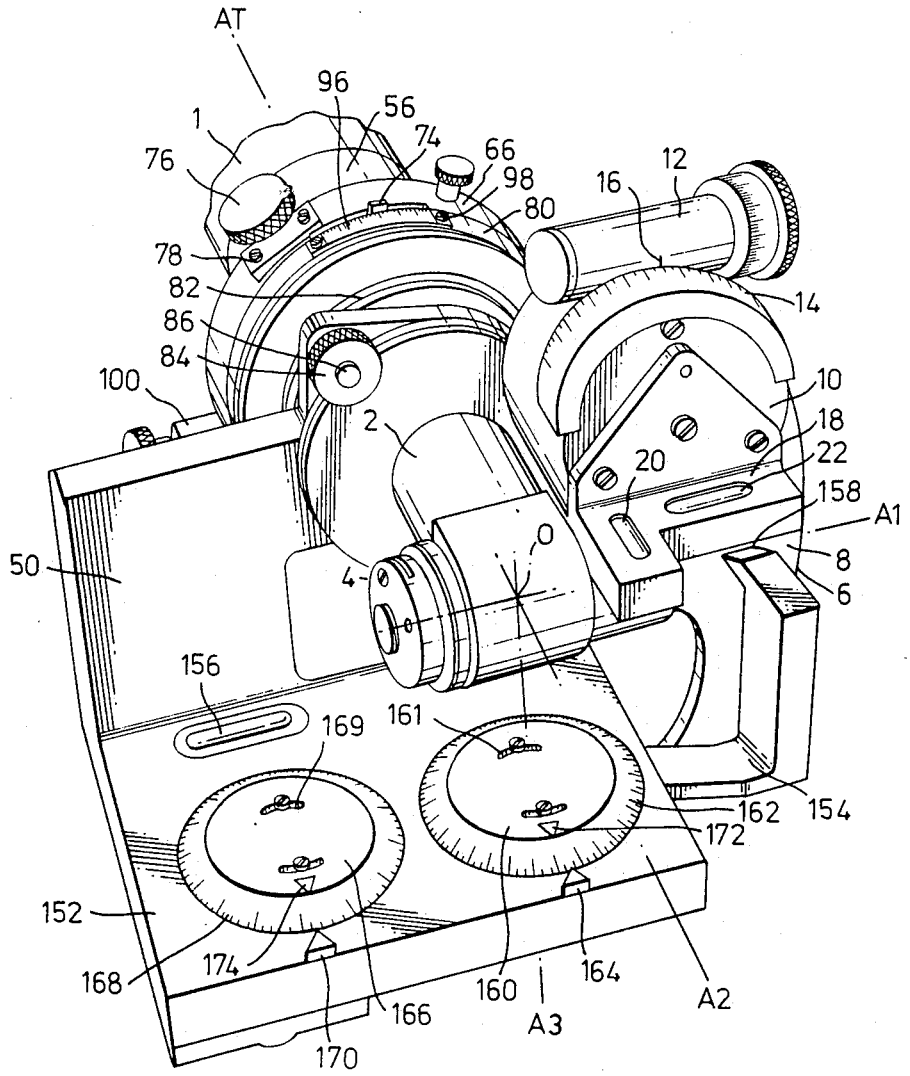
FIG. 6 is a perspective view of a second embodiment in which the reference member is mounted directly on the support member.

Referring now to FIG. 6 there is shown a gun laying aid identical to the first embodiment shown in FIGS. 1 to 5 except for the construction of the reference member, the means for mounting it on the support member and the construction of the correction indicator.

In particular there is shown a right angular bracket 150 mounted on the support member 2 so as to be rotatable about the second axis A2, which axis intersects the first axis A1 perpendicularly at the common intersection point 0.

A reference platform 152 constituting the reference member is fixed to the right angular bracket 150. A lever 154, constituting the correction indicator, in pivotally mounted on the reference member 152 so as to be pivotable about an axis A3, constituting the third axis, which intersects the first and the second axis A1 and A2 at the common intersection point 0. A longitudinal levelling bubble 156 mounted on the reference platform 152 is arranged to indicate when the third axis A3 lies in a vertical plane. The transverse levelling bubble 20 and the longitudinal levelling bubble 156 together constitute the level indicating means.

The lever 154 has an extremity in the form of a knife-edge 158 which is horizontally colinear with the common intersection point 0 when the gun-laying aid is in the operative position and maintained in contact with the indicator portion 8 by a spring (not shown) operating between the lever 154 and the reference platform 152.

Mounted on the lever 154 is a first circular scale carrier 160 coaxial with the third axis A3. It is fixed to the lever 154 by means of two locking screws 161. A circular slip scale 162 is set on the scale carrier 160 coaxial with it. The angular position of the lever 154 relative to the reference platform 152 can be measured by means of the pointer 164 fixed to the reference platform 152.

A second circular scale carrier 166 having a slip scale 168 is fixed to gearing (not shown) by two locking screws 169. The gearing is connected to the first scale carrier 160 and arranged to rotate the second scale carrier 166 at a rate 64 times that of the first scale carrier 160 to permit fine measurement of the angular position of the lever 154 relative to the reference platform 152 by use of pointer 170 fixed to the reference platform 152(measurement in mils).

The scale carriers 160 and 166 are each marked with command pointer 172 and 174 respectively positioned so as to be aligned with the pointers 164 and 166 when the gun-laying aid is in the operative position and the gun horizontal. This forms part of the initial alignment of the gun laying aid described in detail below.

The steps necessary to use either of the gun laying aid as described above fall into three distinct groups. The first group comprises the steps involved in the initial alignment of the gun laying aid during manufacture and the fixing of the mounting ring 66 and the mounting flange 56 on the gun trunnion 1. The gun laying aid as described with reference to FIGS. 1 and 3 is aligned on a jig by aligning the bubble level 34 and the T-bubble plane level 18 to the plate 30 and the plate 6, respectively, and then zeroing the bearing correction scale 46 and the elevation scale 14.

The gun laying aid as described with reference to FIG. 6 is also aligned on a jig. In this case the bubble 156 and the T-bubble plane level 18 are aligned to the platform 152 and the plate 6 respectively. The scale carriers 160 and 166 are zeroed to the pointers 164 and 170 and the elevation scale 14 is zeroed to the datum line 16.

In each of the embodiments the mounting flange 56 is fixed to the gun trunnion 1 by the securing nut 60. The mounting ring 66 is fixed axially on the mounting flange 56 by the mounting plate 70. They remain mounted on the gun trunnion 1 even when the electronic plane converter is functioning so that the gun laying aid may be quickly mounted for use.

The second group comprises the steps involved in adjusting the gun laying aid so that it may be accurately set to the gun-line when mounted on the mounting ring 66. The same procedure is carried out in respect of both embodiments described above. The gun laying aid is fixed to the mounting plate 70 by the clamps 102 and the gun set to the horizontal position. Preferably the gun trunnion 1 is nearly horizontal. The elevation drum 10 is set to read zero and the plate 6 set to the vertical position. If the longitudinal levelling bubble 22 is not showing level the detent locating screws 78 are loosened and the support member 2 and the mounting ring 66 are rotated together relative to the mounting flange 56, keeping the plate 6 set in the vertical position, until it does read level. The locating screws 78 are then tightened to hold the detent plunger 76 fixed relative to the mounting ring 66. The survey scale 96 is moved circumferentially relative to the mounting flange 56 until the zero of the survey scale 96 is next to the pointer 74 where it is fixed in position by tightening the locating screws 98. The gun laying aid may then be demounted from the mounting ring 66 and stored.

The third group comprises the steps involved in surveying-in the gun to the centre of arc bearing or laying the gun to directed co-ordinates which steps will first be described with reference to the first embodiment.

Most usually the gun will have been surveyed-in to the centre of arc bearing, the sight aligned with a chosen gun aiming point and the sight scales slipped to read the centre of arc bearing when the electronic plane converter fails. The gun laying aid can then be used to lay the gun at directed, or "commanded", co-ordinates as follows.

(A) The commanded elevation is set on the elevation drum 10 by means of the fine adjustment control 12 and the sight head rotated until the sight scale reads the command bearing. The turret is then traversed until the sight is once again aligned to the gun aiming point.

(B) The gun is elevated until the longitudinal levelling bubble 22 is levelled with the plate 6 vertical as indicated by the transverse levelling bubble 20. The clamping nut 84 is loosened so that the right angular bracket 24 can be rotated about the support member 2 to set the fourth axis A4 in the horizontal position as indicated by the longitudinal levelling bubble 34. The right angular bracket is then clamped in position by retightening the clamping nut 84. The bearing correction scale 46 then lies in the horizontal plane.

(C) The pointer extremity 44 will then indicate on the bearing correction scale 46 the magnitude of the bearing correction to be applied to the gun. If the bearing correction indicated is positive the bearing set on the sight is increased and if negative, decreased. The gun turret is then traversed to realign the sight with the gun aiming point so bringing the actual bearing of the gun to the directed bearing.

The operation of traversing the turret to realign the sight on the gun aiming point will, in general, alter the elevation and trunnion tilt of the gun. The elevation of the gun will need to be reset and the additional bearing correction to be applied to the sight measured by repeating steps A to C above. The zero of the adjustable scale 48 is set to the bearing correction indicator 44 before the gun laying aid is moved from its previous setting. The previously described steps are repeated but with the additional bearing correction being read from the adjustable scale 48. A single repetition will normally give a sufficiently accurate lay but, if desired, further repetition may be performed.

When the gun laying aid as described with reference to FIG. 6 is used the following steps are followed to lay the gun at commanded coordinates.

(A) The commanded elevation is set on the elevation drum 10 by means of the fine adjustment control 12 and the sight head rotated until the sight scale reads the command bearing. The turret is then transversed until the sight is once again aligned to the gun aiming point.

(B) The gun is elevated until the longitudinal levelling bubble 22 is levelled with the plate 6 vertical as indicated by the transverse levelling bubble 20. The clamping nut 84 is loosened so that the sight angular bracket 150 can be rotated about the support member 2 to set the third axis A3 in a vertical plane as indicated by the longitudinal levelling bubble 156. The right angular bracket 150 is then clamped in position by retightening the clamping nut 84.

(C) The angular rotation of the command pointer 172 on the scale carrier 160 relative to the pointer 164 will then be equal to the magnitude of the bearing correction to be applied to the gun. By setting the slip scales 162 and 168 so that the commanded bearing is next to the command pointers 172 and 174 on the scale carriers 160 and 166, the corrected bearing to be set on the sight can be read off from the slip scales 162 and 168 using the pointers 164 and 170 fixed to the reference platform. The gun turret is then traversed to realign the sight with the gun aiming point so bringing the actual bearing of the gun closer to the directed bearing.

As with the first embodiment steps A to C may be repeated for greater accuracy.

Several important advantages accrue from using the second embodiment (having slip scales) over the first embodiment having a fixed bearing correction scale 46. With the fixed scale the user measures the magnitude of the bearing correction which must be added to the sight setting to determine the new, corrected bearing. Once this is set on the sight the original commanded bearing must be remembered or noted down if it is to be referred to again by the user. Using the slip scales both of these disadvantages are overcome. The command bearing is set to the pointers 172 and 174 by rotating the slip scales 162 and 168 so providing a record of the commanded bearings, and the bearing to be set on the sight is read directly from the step scales without the need for any calculation.

If it is necessary to survey-in the gun to the centre of arc bearing using the first embodiment the gun laying aid the above described mounting means allows the following procedure to be followed which has been found to give a sufficiently accurate survey-in for operational requirements while involving simple manipulations of the gun laying aid. The object of the procedure is to correct for the offset of the sight caused by aligning the sight on the director when the trunnion is tilted.

The sight is rotated to read zero on the main fixed scales bringing the sight-line parallel to the gun-line. The turret is then traversed and the sight mirror elevation adjusted so that the sight is aligned on the director. The gun is then elevated or depressed until it is parallel with the traverse race ring.

The elevation of the sight mirror is then read from the scale in the sight. The detent plunger 76 is released and the support member 2 rotated relative to the gun trunnion 1 by an angle equal to the measured sight elevation. This angle is indicated by the pointer 74 on the survey scale 96. The support member 2 is then fixed relative to the gun trunnion 1 by means of the locking screw 100. The first axis A1 is now parallel to the sight-line which is aligned on the director.

The plate 6 is then set to the vertical position, the scale carrier 28 levelled and the bearing correction determined as described earlier. The sight is offset by an amount equal to the indicated bearing correction and the gun traversed to once again align the sight on the director.

The gun is now ready to receive fire control commands from the command post and the gun laying aid used as previously described.

An analogous procedure can be followed using the second embodiment.

I claim:

1. A gun laying aid characterised in that it includes a support member;

a bearing indicating member pivotally mounted on the support member so as to be pivotable about a first axis and having an indicator portion extended in a plane parallel to the first axis;

a reference member rotatably mounted on the support member (2) so as to be rotatable about a second axis which intersects the first axis perpendicularly at a common intersection point;

a correction indicator pivotally mounted on the reference member so as to be pivotable about a third axis which intersects the second axis at the said common intersection intersection point and is contactable with the indicator portion of the bearing indicating member;

a measuring means co-operative with the reference member and the correction indicator conjointly so as to measure their relative angular displacement about the third axis; and level indicating means arranged to indicate when the indicator portion of the bearing indicating member and the third axis lie in vertical planes.

2. A gun-laying aid as claimed in claim 1 characterised in that there is a restraint means which maintains the correction indicator in contact with the indicator portion of the bearing indicating member.

3. A gun-laying aid as claimed in claim 1 characterised in that the indicator portion is a planar surface.

4. A gun-laying aid as claimed in claim 2 characterised in that the bearing indicating member is a plate.

5. A gun-laying aid as claimed in claim 1 characterised in that the indicator portion lies in a plane containing the first axis.

6. A gun-laying aid as claimed in claims 1 characterised in that the reference member is mounted on the support member by means of an intermediate support member configured to allow the reference member to rotate independently about both the second axis, and a fourth axis which intersects the second axis perpendicularly at the common intersection point.

7. A gun-laying aid as claimed in claim 4 characterised in that the restraint means comprises rollers attached to the correction indicator and engaged with the plate.

8. A gun-laying aid as claimed in claim 1 characterised in that the correction indicator contacts the indicator portion at a knife edge the extension of which intersects the third axis perpendicularly at the common intersection point.

9. A gun laying aid as claimed in claim 1 characterised in that the correction indicator is a pointer having a point and the measuring means comprises a bearing correction scale fixed to the reference member adjacent the point.

10. A gun-laying aid as claimed in claim 1 characterised in that the measuring means comprises at least one circular scale rotatable relative to the reference member by the correction indicator.

11. A gun-laying aid as claimed in claim 1 characterised in that there is also included an elevation drum mounted on the bearing indicating member rotatable about an axis perpendicular to the indicator portion.

* * * * *